US011425999B2

(12) United States Patent
Hu

(10) Patent No.: US 11,425,999 B2
(45) **Date of Patent: *Aug. 30, 2022**

(54) SUPPORTING ARM FOR A STORAGE RACK

(71) Applicant: Designa Inc., Guangdong (CN)

(72) Inventor: Yajun Hu, Guangdong (CN)

(73) Assignee: DESIGNA INC., Guangdong (CN)

( * ) Notice: Subject to any disclaimer, the term of this patent is extended or adjusted under 35 U.S.C. 154(b) by 192 days.

This patent is subject to a terminal disclaimer.

(21) Appl. No.: 16/871,256

(22) Filed: May 11, 2020

(65) Prior Publication Data

US 2020/0352330 A1 Nov. 12, 2020

(30) Foreign Application Priority Data

May 10, 2019 (CN) ..... 201920675522.X

(51) Int. Cl.
*A47B 96/06* (2006.01)
*A47B 96/02* (2006.01)
*A47B 57/12* (2006.01)

(52) U.S. Cl.
CPC ..... *A47B 96/066* (2013.01); *A47B 57/12* (2013.01); *A47B 96/024* (2013.01); *A47B 2220/0036* (2013.01); *A47B 2230/0003* (2013.01)

(58) Field of Classification Search
CPC ..... A47B 96/066; A47B 96/024; A47B 57/12; A47B 57/36; A47B 57/40; A47B 2220/0036; A47B 2230/0003
See application file for complete search history.

(56) References Cited

U.S. PATENT DOCUMENTS 3,102,641 A * 9/1963 Konstant ..... A47B 57/30 211/191
3,862,691 A * 1/1975 Mori ..... A47B 57/40 211/191
4,317,523 A * 3/1982 Konstant ..... A47B 57/402 108/107

(Continued)

FOREIGN PATENT DOCUMENTS

DE 3408575 A1 * 9/1985 ..... A47B 96/024
DE 3732738 A1 * 12/1988 ..... A47B 47/021

(Continued)

*Primary Examiner* — Stanton L Krycinski
(74) *Attorney, Agent, or Firm* — Muncy, Geissler, Olds & Lowe, P.C.

(57) ABSTRACT

This invention provides a supporting arm for a storage rack, comprising a body; a supporting portion for installing a board; and a first tab and a second tab for engaging a frame body structure; the body is provided with a vacant portion for the second tab to be engaged with the frame body structure; the supporting portion is connected to the body; the first tab is provided at one end of the body, the second tab is disposed near the other end of the body and facing the vacant portion, so that the supporting portion for installing the board is fixed on the frame body structure through the first tab and the second tab. The supporting arm for a storage rack of the invention has a simple structure and strong practicability. Not only can the supporting arm form a stable connection with a frame body structure, it also provides the storage rack better support effect, thereby improving the structural strength of the storage rack.

9 Claims, 2 Drawing Sheets

(56) References Cited

U.S. PATENT DOCUMENTS

| | | | | | |
|---|---|---|---|---|---|
| 4,342,397 | A * | 8/1982 | Halstrick | F16B 7/22 | 211/191 |
| 4,796,541 | A * | 1/1989 | Halstrick | A47B 57/402 | 108/107 |
| 6,223,916 | B1 * | 5/2001 | Enos | A47B 57/40 | 211/187 |
| 6,491,173 | B1 * | 12/2002 | Costa | A47B 88/427 | 211/126.15 |
| 6,920,831 | B2 * | 7/2005 | Lin | A47B 57/40 | 108/107 |
| 9,167,896 | B1 * | 10/2015 | Wu | A47B 57/40 | |
| 9,713,379 | B1 * | 7/2017 | Tsai | A47B 47/0083 | |
| 9,888,770 | B1 * | 2/2018 | Chen | A47B 57/40 | |
| 10,206,506 | B1 * | 2/2019 | Lai | A47B 96/1433 | |
| 11,006,750 | B2 * | 5/2021 | Chiu | A47B 96/06 | |
| 2006/0243692 | A1 * | 11/2006 | Proffitt | A47B 57/48 | 211/187 |
| 2008/0296245 | A1 * | 12/2008 | Punzel | A47B 47/021 | 211/153 |
| 2011/0272541 | A1 * | 11/2011 | Wojtowicz | A47B 87/0215 | 248/218.4 |
| 2015/0282613 | A1 * | 10/2015 | Chen | A47B 96/1408 | 211/187 |
| 2017/0197647 | A1 * | 7/2017 | Bouma | B62B 3/005 | |
| 2017/0280875 | A1 * | 10/2017 | Buckley | A47B 47/021 | |
| 2021/0219722 | A1 * | 7/2021 | Hu | A47B 96/024 | |

FOREIGN PATENT DOCUMENTS

| | | | | | |
|---|---|---|---|---|---|
| DE | 102011009275 | A1 * | 8/2011 | A47B 96/024 | |
| EP | 2589315 | A1 * | 8/2013 | | |
| FR | 2459629 | A1 * | 1/1981 | A47B 57/408 | |
| FR | 2484806 | A1 * | 12/1981 | A47B 57/402 | |
| FR | 2516770 | A1 * | 5/1983 | A47B 57/38 | |
| FR | 2575911 | A1 * | 7/1986 | F16B 12/14 | |
| FR | 2579431 | A1 * | 10/1986 | A47B 96/1441 | |
| FR | 2818518 | A1 * | 6/2002 | A47B 57/36 | |
| GB | 929049 | A * | 6/1963 | A47B 57/425 | |
| GB | 1123761 | A * | 8/1968 | A47B 57/48 | |
| GB | 2114874 | A * | 9/1983 | A47B 57/402 | |
| GB | 2217185 | A * | 10/1989 | A47B 57/36 | |
| KR | 20090039527 | A * | 4/2009 | | |
| KR | 20110008236 | U * | 8/2011 | | |
| WO | WO-9427474 | A1 * | 12/1994 | A47B 81/002 | |

* cited by examiner

SUPPORTING ARM FOR A STORAGE RACK

TECHNICAL FIELD

This invention relates to a supporting arm for a storage rack.

TECHNICAL BACKGROUND

Storage racks are relatively common tool for storing and displaying goods, and is widely used in various industries due to its simple structure, light weight, and convenience in assembling and disassembling.

Most general storage racks are formed by supporting frame structures and supporting plates. Common storage rack structures on the market are relatively simple, most of which adopt the way that the supporting arms are installed on the vertical columns or the back plate through snap structure, and boards are supported on the supporting arms. Storage racks in this way are usually provided with a plurality of equidistant mounting holes vertically on the vertical columns or the back plate, and the supporting arms are provided with corresponding insertion parts matching the mounting holes. Based on the size and needs of the actual storage items, the installation position of the supporting arms on the vertical columns and back plate can be adjusted, so as to adjust the distance between two adjacent boards.

However, there is only one point of connection between the supporting arms and the vertical columns or back panel, and its support effect is not good. When holding heavy goods, the supporting arms and the boards shake easily or even break. This will greatly affect the structural strength and service life of the storage racks, and also affect the consumers' experience.

SUMMARY OF THE INVENTION

The purpose of the invention is to overcome the shortcomings and deficiencies of the prior art, and to provide supporting arms for a storage rack with a simple structure and strong practicability. Not only can the supporting arms form a stable connection with the frame body structure, but also provide the storage rack with better supporting effect, thereby improving the structural strength of the storage rack.

In order to achieve the above objectives, the present invention presents the following technical solutions: a supporting arm for a storage rack, comprising a body; a supporting portion for installing a board; and a first tab and a second tab for engaging a frame body structure; the body is provided with a vacant portion for the second tab to be engaged with the frame body structure; the supporting portion is connected to the body; the first tab is provided at one end of the body, the second tab is disposed near the other end of the body and facing the vacant portion, so that the supporting portion for installing the board is fixed on the frame body structure through the first tab and the second tab.

In the above solutions, the supporting arm of the present invention can be engaged and connected with vertical columns of the frame body structure through the first tab, and at the same time, it is snapped onto the vertical columns of frame body structure through vacant portion, so that the second tab can be engaged with the vertical columns of the frame body structure. Therefore, the present invention realizes the stable connection between the supporting arms and the vertical columns of the frame body structure through double engagements of the snap connections of the first tab and the second tab, and the frame body structure. For the supporting arms of a single-sided frame body structure, this structure makes the supporting portion of the support arm have two points for receiving force, thereby improving the support effect of the supporting arm. When holding heavy goods, the supporting arms and the boards on the supporting arms will not shake or even break, thus greatly improves the structural strength and service life of the side frames of the storage shelf.

The vacant portion of the body for the second tab to be engaged with the frame body structure is provided as follow: an end of the body away from the first tab is provided with a concave portion, and the concave portion is used as the vacant portion where the body and the frame body structure are engaged.

The second tab disposed near the other end of the body and facing the vacant portion is provided as follow: the second tab is provided on a side wall of the vacant portion and facing the vacant portion.

A distance from the second tab to the other side wall of the vacant portion is greater than a width of an engagement location of the frame body structure. This design enables the body to be snapped into a vertical column of the frame body structure through the vacant portion, and has enough space for the second tab to be engaged with the vertical column of the frame body structure.

The supporting portion is vertically connected to the body and integrally formed with the body. This design can improve the structural strength of the supporting arm.

The invention further comprises a reinforcement rod for strengthening a connection of the supporting portion and the body, and the body is connected to the supporting portion through the reinforcement rod.

The supporting portion is provided with at least one protruding part for installing a board. The board is provided with through hole for connecting the protruding part. The board can achieve a stable installation on the supporting portion through a connection of the through holes and the protruding part.

The invention further comprises a fixing block for restricting a movement of the body of a supporting arm on the frame body structure; the fixing block is detachably connected to a side wall of the vacant portion, and when used, it is located between the side wall of the vacant portion and the frame body structure. After a supporting arm is engaged with the frame body structure through the first tab and the second tab, by inserting a fixing block between a side wall of the vacant portion and the frame body structure, the body of the supporting arm can be restricted from moving on the frame body structure to further improve the stability of the supporting arm.

One end of the fixing block is detachably connected to a side wall of the vacant portion away from the second tab, and the other end is against the frame body structure.

One end of the fixing block is detachably connected to a side wall of the vacant portion away from the second tab is provided as follow: the fixing block is provided with a convex portion at one end, and the side wall away from the second tab is provided with a slot corresponds to the convex portion, and the fixing block are detachably connected to the side wall away from the second tab through an engagement of the convex portion and the slot.

The supporting arms for a storage rack of the invention is used in this manner: after the body of a supporting arm of the present invention is engaged with the vertical column of the frame body structure through the vacant position, the first tab and the second tab are engaged and connected to a vertical column of the frame body structure. Finally, after the body is securely engaged with the frame body structure, the fixing block is inserted through the convex portion and the slot of a side wall of the vacant portion such that the fixing block is fixed between the side wall of the vacant portion away from the side wall of the second tab and the frame body structure, to limit the movement of the body of the supporting arm on the frame body structure, thereby further improving the stability of the supporting arm.

Compared with the prior art, the invention has the following advantages and beneficial effects: The supporting arm for a storage rack of the invention has a simple structure and strong practicability. Not only can the supporting arm form a stable connection with the frame body structure, but also provide the storage rack better support effect, thereby improving the structural strength of the storage rack.

Among them, 1 represents a body, 2 represents a board, 2.1 represents through holes, 3 represents a supporting portion, 4 represents frame body structure, 4.1 represents a vertical column, 5 represents a first tab, 6 represents a second tab, 7 represents a vacant portion, 7.1 represents a slot, 8 represents a protruding part, 9 represents a fixing block, 9.1 represents a convex portion, 10 represents a reinforcing rod.

DESCRIPTION

The invention will be described in further detail below with reference to the drawings and specific examples.

Examples

Figure 1:
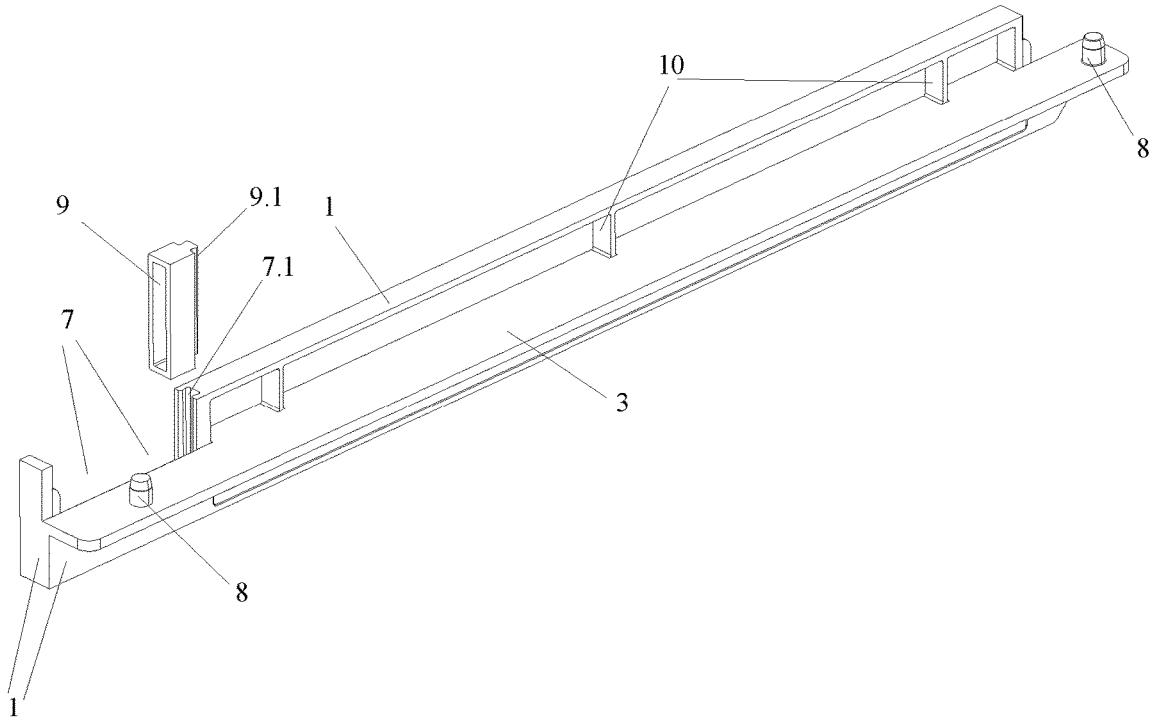
FIG. 1 is diagram 1 of a supporting arm for a storage rack of the present invention.
Figure 2:
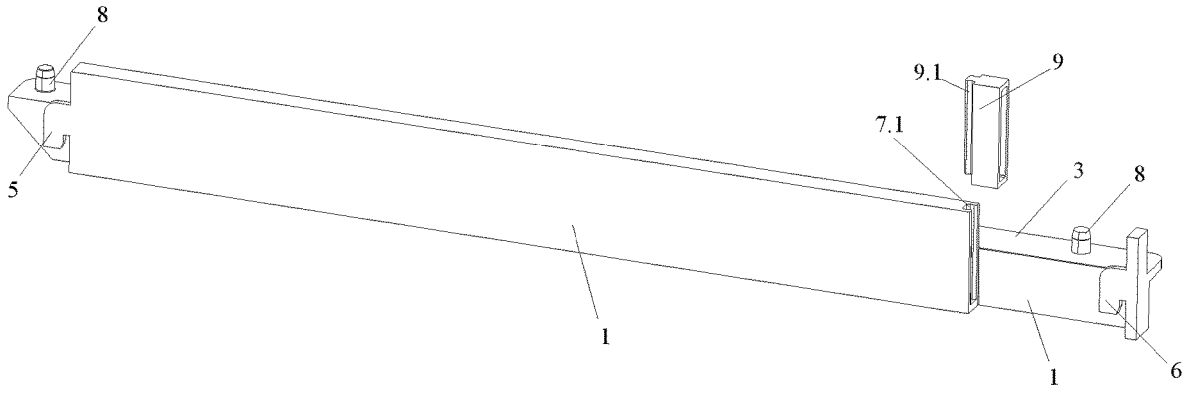
FIG. 2 is diagram 2 of the supporting arm for a storage rack of the present invention.
Figure 3:
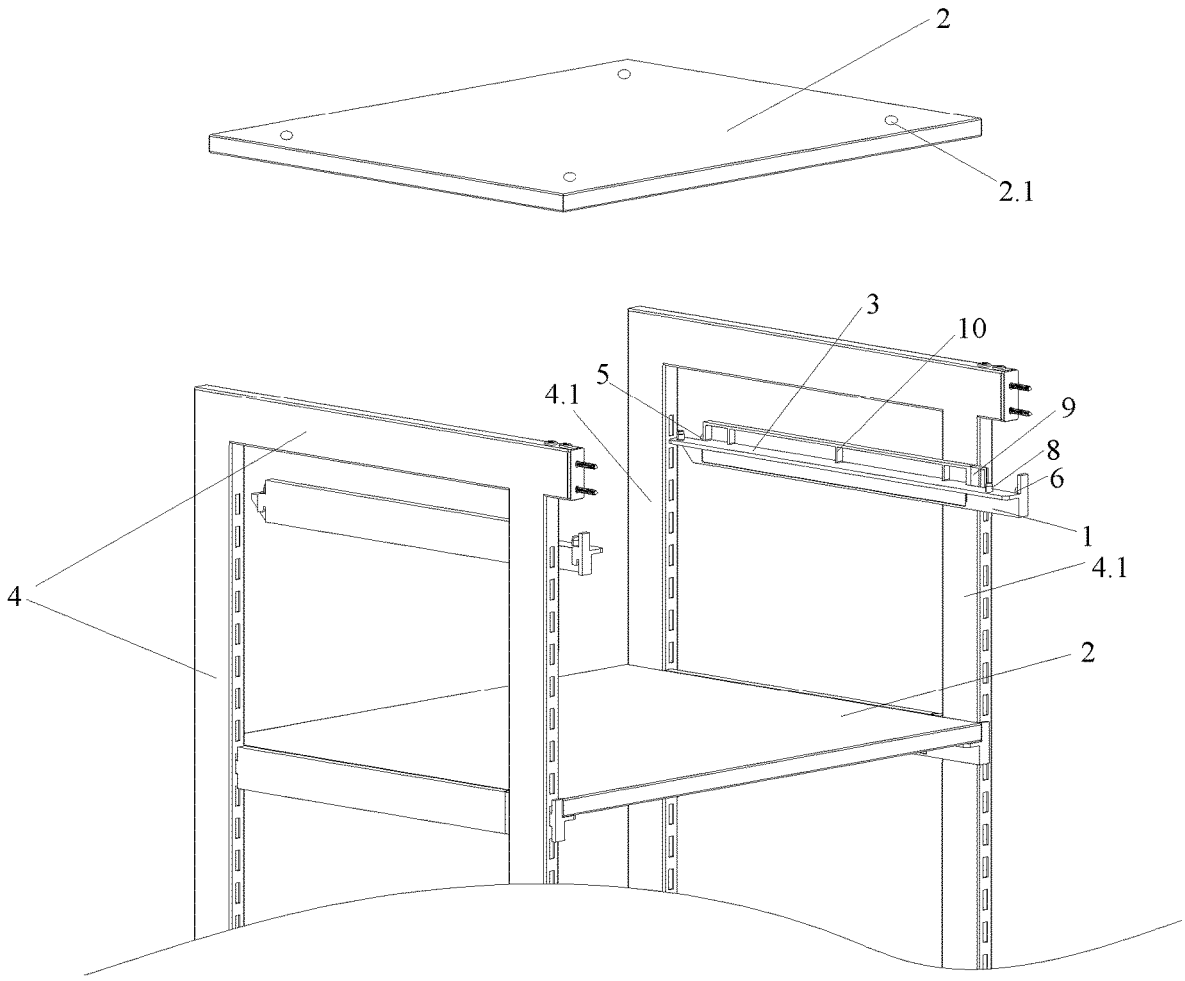
FIG. 3 is a diagram of the invention when the storage rack supporting arm is in use.

As shown in FIGS. 1 to 3, a supporting arm for a storage rack of the present invention comprise body 1, supporting portion 3 for mounting board 2, and first tab 5 and second tab 6 for matching engagement with a frame body structure 4, where body 1 is provided with a vacant portion 7 to facilitate the engagement of the second tab 6 and the frame body structure 4. The supporting portion 3 is connected to the body 1, the first tab 5 is set at one end of the body 1, and the second tab 6 is close to the other end of the body 1 and faces the vacant portion 7, and the supporting portion 3 for mounting the board 2 is fixed on the frame body structure through the first tab 5 and the second tab 6. Both first tab 5 and second tab 6 are inverted hooks.

The body 1 is provided with a vacant portion 7 which facilitates the engagement of the second tab 6 and the frame body structure 4 means that the body 1 has a concave portion at the end away from the first tab 5, and the concave portion serves as vacant portion 7 where the body 1 and the frame body structure 4 are engaged. The second tab 6 is provided on the side wall of the vacant portion 7 and faces the vacant portion 7. Moreover, the distance from the second tab 6 to the other side wall of the vacant portion 7 is greater than a width of an engagement location of the frame body structure 4. The design allows body 1 to be snapped onto the frame body structure 4 through the vacant portion 7, and there is enough space for the second tab 6 to engage with the frame body structure.

The supporting portion 3 of the invention is vertically connected with the body 1, and is integrally formed with the body 1. This design can improve the structural strength of supporting arms. In order to strengthen the connection between the supporting portion and the body, the present invention further comprises a reinforcing rod 10, and the body 1 is connected to the supporting portion 3 through the reinforcing rod 10. The supporting portion 3 is provided with at least one protruding part 8 for installing boards 2. Through holes 2.1 is provided on the boards 2 for connecting with the protruding part 8 and boards 2 can achieve a stable installation on the supporting portion 3 through a connection of the through holes 2.1 and the protruding part 8.

The invention also comprises a fixing block 9 for restricting the movement of the body 1 on the frame body structure 4, the fixing block 9 is detachably connected to the side wall of the vacant portion 7, and when used is located between the side wall of the vacant portion 7 and the frame body structure 4. When supporting arms are connected to the frame body structures with first tab 5 and second tab 6, by inserting fixing block 9 between the side wall of vacant portion 7 and the frame body structure 4, body 1 of supporting arms can be restricted from moving on the frame body structure to further improve the stability of supporting arms 3. One end of the fixing block 9 of the present invention is detachably connected to the side wall of the vacant portion 7 away from the second tab 6, and the other end is against the frame body structure 4. Specifically, the fixing block 9 and the side wall of the vacuum portion 7 are connected as follows: one end of the fixing block 9 is provided with a convex portion 9.1, and the side wall of the vacuum portion 7 away from the second tab 6 is provided with the matching slot 7.1 correspond to the convex portion 9.1. Fixing block 9 can be detachably connected to the side wall of the vacant portion 7 away from the second tab 6 through the insertion of the convex portion 9.1 to slot 7.1.

The supporting arms for a storage rack of this invention is used in this manner: after the body 1 of a supporting arm of the present invention is engaged with a vertical column 4.1 of the frame body structure 4 through the vacant position 7, the first tab 5 and the second tab 6 are engaged and connected to a vertical column 4.1 of the frame body structure. Finally, after the body 1 is securely engaged with the vertical column 1 of the frame body structure 4, the fixing block 9 is inserted through the convex portion 9.1. and the slot 7.1 of a side wall of the vacant portion 7 such that the fixing block 9 is fixed between the side wall of the vacant portion 7 away from the side wall of the second tab 6 and the frame body structure, to limit the movement of the body 1 of supporting arm on the frame body structure 4, thereby further improving the stability of the supporting arms.

The invention forms a stable connection between the supporting arms 3 and the frame body structure 4 through double engagements of the snap connections of the first tab 5 and the second tab 6, and the frame body structure 4. For the supporting arms of a single-sided frame body structure, this structure makes the supporting portion of the support arm have two points for receiving force, thereby improving the support effect of the supporting arm. When holding heavy goods, the supporting arms and the boards on the supporting arms will not shake or even break, thus greatly improves the structural strength and service life of the side frames of the storage shelf.

The above examples are preferred embodiments of the present invention, but the embodiments of the present invention are not limited by the above examples. Any other changes, modifications, substitutions, combinations, simplifications, etc. made without departing from the spirit and principle of the present invention should all be equivalent replacement methods, which are all included within the protection scope of the present invention.

The invention claimed is:

1. A supporting arm for a storage rack, comprising a body; a supporting portion for installing a board; and a first tab and a second tab for engaging a frame body structure; the body is provided with a vacant portion for the second tab to be engaged with the frame body structure; the supporting portion is connected to the body; the first tab is provided at one end of the body, the second tab is disposed near the other end of the body and facing the vacant portion, so that the supporting portion for installing the board is fixed on the frame body structure through the first tab and the second tab;

wherein the supporting arm further comprises a fixing block for restricting a movement of the body of the supporting arm on the frame body structure; the fixing block is detachably connected to a side wall of the vacant portion, and when used, it is located between the side wall of the vacant portion and the frame body structure.

2. The supporting arm for a storage rack according to claim 1, wherein the vacant portion of the body for the second tab to be engaged with the frame body structure is provided as follow: an end of the body away from the first tab is provided with a concave portion, and the concave portion is used as the vacant portion where the body and the frame body structure are engaged.

3. The supporting arm for a storage rack according to claim 1, wherein the second tab disposed near the other end of the body and facing the vacant portion is provided as follow: the second tab is provided on a side wall of the vacant portion.

4. The supporting arm for a storage rack according to claim 3, wherein a distance from the second tab to another side wall of the vacant portion is greater than a width of an engagement location of the frame body structure.

5. The supporting arm for a storage rack according to claim 1, wherein the supporting portion is integrally formed with the body.

6. The supporting arm for a storage rack according to claim 5, further comprises a reinforcement rod for strengthening a connection of the supporting portion and the body, and the body is connected to the supporting portion through the reinforcement rod.

7. The supporting arm for a storage rack according to claim 1, wherein the supporting portion is provided with at least one protruding part for installing a board.

8. The supporting arm for a storage rack according to claim 1, wherein one end of the fixing block is detachably connected to a side wall of the vacant portion away from the second tab, and the other end is against the frame body structure.

9. The supporting arm for a storage rack according to claim 8, wherein one end of the fixing block is detachably connected to a side wall of the vacant portion away from the second tab is provided as follow: the fixing block is provided with a convex portion at one end, and the side wall away from the second tab is provided with a slot corresponds to the convex portion, and the fixing block are detachably connected to the side wall away from the second tab through an engagement of the convex portion and the slot.

* * * * *